US006129525A

United States Patent [19]

Reynolds

[11] Patent Number: 6,129,525

[45] Date of Patent: Oct. 10, 2000

[54] SPEED CONTROL FOR FLUID POWERED DIAPHRAGM PUMPS

[75] Inventor: Steven M. Reynolds, Lucas, Ohio

[73] Assignee: Warren Rupp, Inc., Mansfield, Ohio

[21] Appl. No.: 09/139,185

[22] Filed: Aug. 25, 1998

[51] Int. Cl.[7] ..... F04B 43/06

[52] U.S. Cl. ..... 417/395; 417/403; 417/375

[58] Field of Search ..... 417/395, 374, 417/393, 403, 375, 46

[56] References Cited

U.S. PATENT DOCUMENTS

| | | | |
|---|---|---|---|
| 3,741,689 | 6/1973 | Rupp . | |
| 3,781,141 | 12/1973 | Schall | 417/395 |
| 3,838,946 | 10/1974 | Schall | 417/395 |
| 3,909,159 | 9/1975 | Jansen et al. | 417/374 |
| 4,371,321 | 2/1983 | Koblo et al. | 418/45 |
| 4,523,901 | 6/1985 | Schippers et al. | 417/395 |
| 4,648,810 | 3/1987 | Schippers et al. | 417/383 |
| 4,966,528 | 10/1990 | Henkel et al. | 417/63 |
| 5,252,041 | 10/1993 | Schumack | 417/395 |
| 5,332,372 | 7/1994 | Reynolds | 417/393 |

*Primary Examiner*—Mark Paschall
*Assistant Examiner*—Jeffrey Pwu
*Attorney, Agent, or Firm*—Hill & Simpson

[57] ABSTRACT

A governor for fluid powered diaphragm pumps is shown and described. At least one pump member or oscillatory member moves in response to the varying pressures in the inner chambers of the diaphragm pump. Thus, each pump member or oscillatory member moves at the frequency at which the pump operates. Each pump member pumps fluid through a hydraulic circuit. The fluid flowing through the hydraulic circuit moves a flow regulator disposed in the line that provides communication between the air or power fluid supply and the main air valve or main valve with a pump. In the event the pump operates too fast or at too high a frequency, the pump member or members will pump hydraulic fluid through the circuit at a sufficient flowrate so as to move the flow regulator to a position where it reduces the flow rate of power fluid to the main valve of the pump. In the event the pump is operating too slow or at too low a frequency, the flowrate of hydraulic fluid in the circuit will consequently be reduced and the flow regulator will be biased towards an open position thereby increasing the rate of flow of power fluid to the main valve of the pump. Manual control of the flowrate through the hydraulic circuit, and therefore manual control of the flow regulator, is also provided.

20 Claims, 2 Drawing Sheets

SPEED CONTROL FOR FLUID POWERED DIAPHRAGM PUMPS

BACKGROUND OF THE INVENTION

Field of the Invention

The present invention is directed generally to fluid powered diaphragm pumps including air operated diaphragm pumps. More specifically, the present invention is directed toward mechanisms for controlling the speed or frequency of such diaphragm pumps and improved methods of speed control for diaphragm pumps. Still more specifically, the present invention relates generally to governors designed as original equipment or as retrofit equipment for diaphragm pumps.

Air-operated diaphragm pumps and fluid powered pumps are widely used for pumping liquids, solutions, viscous materials, slurrys and suspensions containing substantial amounts of solids. Typically, diaphragm pumps are operated under extreme operating conditions that vary. Specifically, the viscosity of the fluid being pumped can vary, particularly when the fluid is a suspension containing solids. The amount of solids in the suspension can vary thereby dramatically affecting the viscosity of the liquid being pumped. In other instances, the viscosity of liquids being pumped can vary depending upon temperature and inconsistencies in the contents of the solution. As a result of a changing viscosity, the head on the suction side of the pump and the back pressure on the pump discharge may all vary substantially. Still further, in a system that includes a number of dispensing stations, one or more of the dispensing stations may be taken out of service or a dispensing station may be added thereby varying the system head.

As a result in changes in the fluid viscosity, system head or back pressure, the frequency or speed of the pump will vary because the air or power fluid supplied to the pump will typically be supplied at a constant pressure. Often, it is undesirable to vary the speed of the pump. Specifically, operators normally desire to have the pump operate at a steady speed or steady stay condition.

Another problem encountered with fluid powered diaphragm pumps is the loss of air or power fluid when the pump runs dry due to the emptying of the sump or tank containing the fluid being pumped. Because most fluid powered diaphragm pumps do not include an automatic cut-off for the air or power fluid, the pump enters into a runaway condition which wastes the air or power fluid.

While governors for fluid powered diaphragm pumps are known from, e.g., U.S. Pat. No. 3,741,689, the teachings of which are incorporated herein by reference, such devices are complicated, difficult to install and not feasible for use as a retrofit or add-on feature to existing pumps.

Therefore, there is a need for an improved fluid powered diaphragm pump or a retrofit kit or add-on feature for fluid powered diaphragm pumps which will enable the speed of the pump to be automatically controlled in response to variances in the viscosity or system head and which will further enable the speed of the pump to be substantially reduced if not stopped in the event the pump runs dry. Due to the large number of fluid powered diaphragm pumps in current use, it would be extremely desirable to provide such a system which could be added to existing pumps at a minimal cost.

SUMMARY OF THE INVENTION

The present invention satisfies the aforenoted needs by providing a governor for a fluid powered diaphragm pump.

It will be noted that the terms right and left are used below for orientation and convenience purposes only in describing the pumps, pistons and chambers of the apparatuses and methods of the present invention.

In an embodiment, the governor provided by the present invention includes a single pump member having an oscillatory movement under varying pressures of the left and right inner chambers of the pump. The pump member is driven the pressure in one inner chamber of the pump and retracted by the pressure in the other inner chamber of the pump. The oscillatory movement of the pump member is transmitted to hydraulic fluid of a hydraulic circuit. The hydraulic fluid flows through the hydraulic circuit engages or otherwise changes the position of a flow regulator that is disposed between a power fluid inlet and a power fluid outlet. The position of the flow regulator controls the flow rate of power fluid from the inlet to the outlet. The power fluid outlet is in communication with the main air valve or main power fluid valve. The position of the flow regulator is controlled by the flow rate of the hydraulic fluid through the circuit.

As a result, if the frequency of the diaphragm pump is increased, the pump member will move back and forth in its oscillatory fashion at a faster rate thereby increasing the flow rate of hydraulic fluid through the circuit. If the flow rate of the hydraulic fluid through the circuit is increased above a predetermined maximum flow rate, the hydraulic fluid will bias the flow regulator to a position where the flow regulator reduces the flow rate of power fluid from the inlet to the outlet thereby reducing the flow rate of power fluid to the main valve and thereby reducing the frequency of the pump.

In contrast, in the event the frequency of the pump is reduced, the pump member will oscillate at a lower rate thereby decreasing the flow rate of hydraulic fluid through the circuit. In the event the flow rate of hydraulic fluid is decreased below a predetermined minimum flow rate, the lack of force imposed on the flow regulator by the hydraulic fluid will result in a movement of the flow regulator to a position where the flow regulator increases the flow rate of power fluid from the inlet to the outlet thereby increasing the frequency of the pump.

In a preferred embodiment, the governor of the present invention comprises two pumps, i.e. a left pump member and a right pump member. The left pump member is driven by the pressure in the left inner chamber of the pump while the right pump member is driven by the pressure in the right inner chamber of the pump.

Each pump has a first side and a second side. The first side of the left pump member is in communication with the left inner chamber of the pump; the second side of the left pump member is in communication with the right inner chamber of the pump. As a result, during operation of the pump, varying pressures in the left and right inner chambers of the pump result in a oscillatory movement of the left pump member back and forth as the pump operates. Pressure from the left inner chamber is imposed on the first side of the left pump member and results in a pumping of hydraulic fluid through a hydraulic circuit while pressure in the right inner chamber retracts the left pump member.

Similarly, the right pump member has a first side and a second side. The first side of the right pump member is in communication with the right inner chamber of the pump while the second side of the right pump member is in communication with the left inner chamber of the pump. Pressure in the right inner chamber causes the right pump member to pump hydraulic fluid through the circuit while pressure in the left inner chamber causes the right pump member to retract.

In an embodiment, the hydraulic circuit of the governor comprises a check valve disposed downstream of the pumps and upstream of the flow regulator.

In an embodiment, the hydraulic circuit further comprises a hydraulic fluid reservoir disposed downstream of the flow regulator and upstream of the pumps.

In an embodiment, the hydraulic circuit of the governor comprises a check valve disposed downstream of the hydraulic fluid reservoir and upstream of the pumps.

In an embodiment, the hydraulic circuit further comprises a throttle valve for controlling the flowrate of hydraulic fluid through the circuit and providing additional control of the frequency of the pump.

In an embodiment, the throttle valve of the present invention is disposed downstream of the flow regulator and upstream of the pumps.

In an embodiment, the throttle valve is disposed downstream of the flow regulator and upstream of the hydraulic fluid reservoir.

In an embodiment, the power fluid is air.

In an embodiment, the present invention provides a method for controlling the frequency of the diaphragm pump. The method includes the steps of providing a governor comprising a left pump member and a right pump member. Each pump having a first side and a second side. The first side of the left pump member is in communication with the left inner chamber of the pump; the second side of the left pump member is in communication with the right inner chamber of the pump. Pressure in the left inner chamber of the pump causes the left pump member to pump hydraulic fluid through a common hydraulic circuit. Pressure in the right inner chamber of the pump causes the left pump member to retract. Similarly, the first side of the right pump member is in communication with the right inner chamber of the pump; the second side of the right pump member is in communication with the left inner chamber of the pump. Pressure in the right inner chamber of the pump causes the right pump member to stroke or pump hydraulic fluid through the common circuit while pressure in the left inner chamber of the pump causes the right pump member to retract. The method further includes the step of moving the left and right pump members in an oscillatory fashion in response to varying pressures in the left and right inner chambers of the pump. The method further comprises the step of pumping hydraulic fluid through a common circuit under movement of the right and left pump members. The hydraulic fluid engages a flow regulator disposed between an air inlet and an air outlet and the position of the flow regulator controls the flowrate of air between the air inlet and the air outlet. The air outlet is in communication with the main air valve of the pump. The method further comprises a step of moving the flow regulator in response to the flowrate of the hydraulic fluid through the circuit.

In an embodiment, the present invention provides a diaphragm pump comprising left and right inner chambers in communication with a main air valve. The main air valve is in communication with an air supply outlet. The air supply outlet is in communication with an air supply inlet. The pump further comprises a governor comprising a left pump member having a first side and a second side and a right pump member having a first side and a second side. The first side of the left pump member is in communication with the left inner chamber of the pump; the second side of the left pump member is in communication with the right inner chamber of the pump. The left pump member is connected to a plunger. The plunger is disposed between the left pump member and a common hydraulic fluid circuit whereby oscillatory movement of the left pump member caused by varying pressures in the left and right inner chambers causes the plunger connected to the left pump member to pump hydraulic fluid through the circuit. Similarly, the first side of the right pump member is in communication with the right inner chamber of the pump; the second side of the right pump member is in communication with the left inner chamber of the pump. The right pump member is connected to a plunger. The plunger is disposed between the right pump member and the common hydraulic fluid circuit whereby oscillatory movement of the right pump member caused by varying pressures in the right and left inner chambers of the pump causes the plunger connected to the right pump member to pump hydraulic fluid through the common circuit. The hydraulic fluid engages a diaphragm disposed between the circuit and a flow regulator. The diaphragm engages the flow regulator. The flow regulator is disposed between the air supply inlet and air supply outlet and the position of the flow regulator between the inlet and outlet controls the flowrate of air from the inlet to the outlet thereby controlling the frequency of the pump. The position of the flow regulator is controlled by the position of the diaphragm which, in turn, is controlled by the flowrate of hydraulic fluid through the circuit. An increase in the flowrate of the hydraulic fluid through the circuit above a predetermined maximum flowrate results in the flow regulator moving to a position where the flow regulator reduces the flowrate of air from the inlet to the outlet thereby decreasing the frequency of the pump. In contrast, a decrease in the flowrate of hydraulic fluid through the circuit below a predetermined minimum flowrate results in the flow regulator moving to a position where the flow regulator increases the flowrate of air from the inlet to the outlet thereby increasing the frequency of the pump.

It is therefore an advantage of the present invention to provide improved frequency control for fluid powered diaphragm pumps.

Another advantage of the present invention is to provide a governor for diaphragm pumps that may be installed as original equipment or in the form of a retrofit kit.

Still another advantage of the present invention is that it provides a method for controlling the frequency of fluid powered diaphragm pumps as well as a method for retrofitting fluid powered diaphragm pumps to include a governor for controlling the frequency thereof.

Still another advantage of the present invention is that it provides a mechanism for avoiding a runaway condition in a diaphragm pump in the event the air or power fluid supply becomes exhausted.

Another advantage of the present invention is that it provides a means for providing a constant frequency for a fluid powered diaphragm pump in the event the viscosity of the fluid being pumped changes before the number of dispensing stations for the fluid being pumped changes.

Other objects and advantages of the present invention will become apparent to those skilled in the art upon reviewing the following detailed description, drawings and appended claims.

From the above description it is apparent that the objets of the present invention have been achieved. While only certain embodiments have been set forth, alternative embodiments and various modifications will be apparent from the above description to those skilled in the art. These and other alternatives are considered equivalents and within the spirit and scope of the present invention.

DESCRIPTION OF THE PRESENTLY PREFERRED EMBODIMENTS

Figure 1:
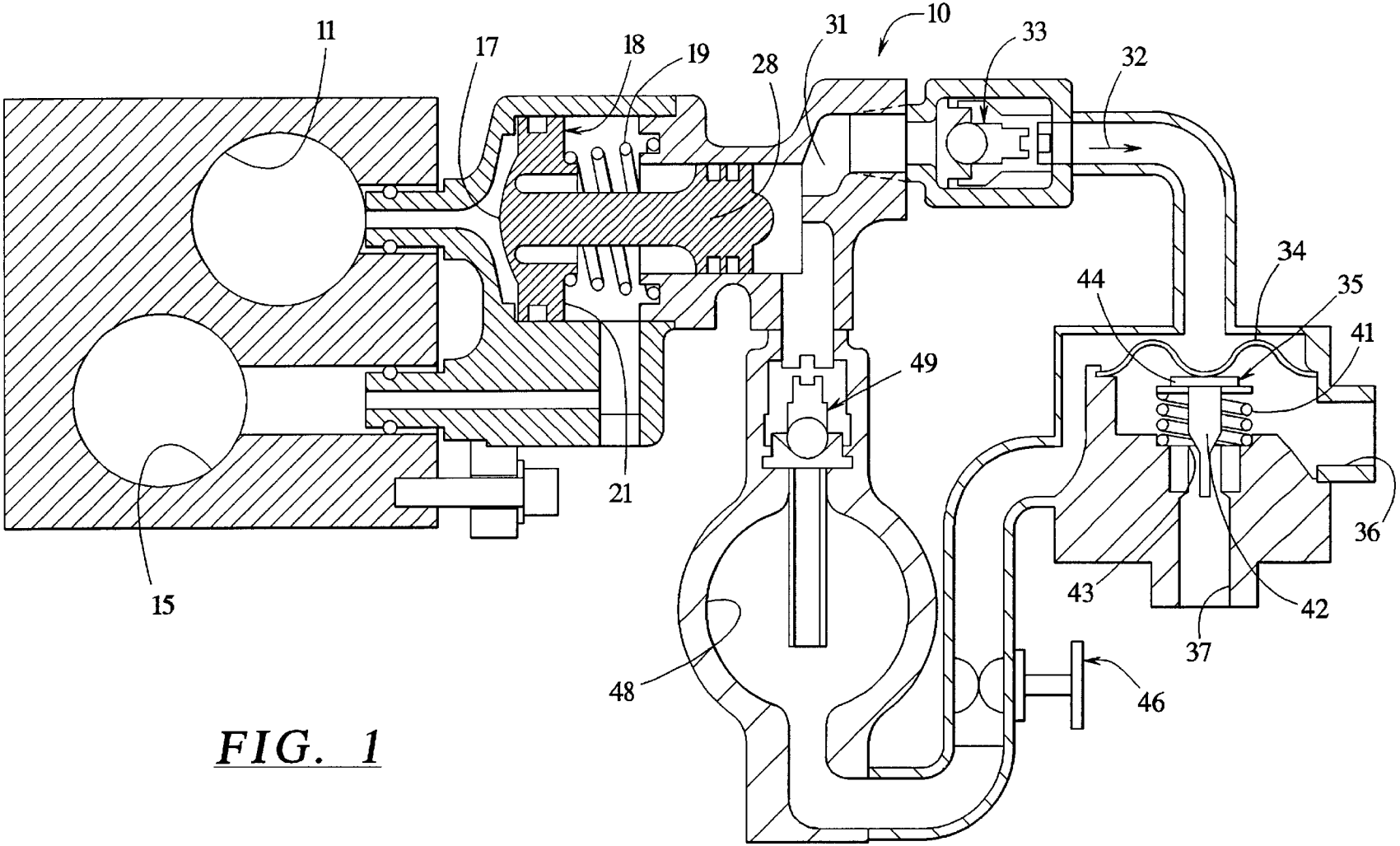
FIG. 1 is a schematic illustration of the governor for a diaphragm pump provided by the present invention.

Referring first to FIG. 1, a frequency control system or governor 10 is partially illustrated in a schematic fashion. The chamber shown at 11 is in communication with one of the inner chambers 12 of the diaphragm pump 14 shown in FIG. 2, which is a schematic illustration of a diaphragm pump sold under the SANDPIPER® trademark by Warren Rupp, Inc. of Mansfield, Ohio. The other chamber 15 is in communication with the other inner chamber 16 of the diaphragm pump 14 shown in FIG. 2. As shown in FIG. 1, the chamber 11 is in communication with a first side 17 of a pump member or piston 18 and the chamber 15 is in communication with a second side 21 of the pump member 18. It will be noted that only a single pump member 18 is shown in FIG. 1. However, as noted above, in the preferred embodiment, two pumps are employed, i.e. a left pump member and a right pump member whereby the left pump member is driven by pressure in the left inner chamber of the pump and retracted by pressure in the right inner chamber of the pump and the right pump member is driven by pressure in the right inner chamber of the pump and retracted by pressure in the left inner chamber of the pump. Both the right and left pump members are connected in parallel to a common hydraulic circuit. For simplicity sake, only a single pump member 18 is shown in FIG. 1 and described below but it will be known that a second identical pump is connected in parallel to the hydraulic circuit with the pump member 18. Further, it will be known that the specific construction shown in FIG. 1 is just one of several possible embodiments.

Figure 2:
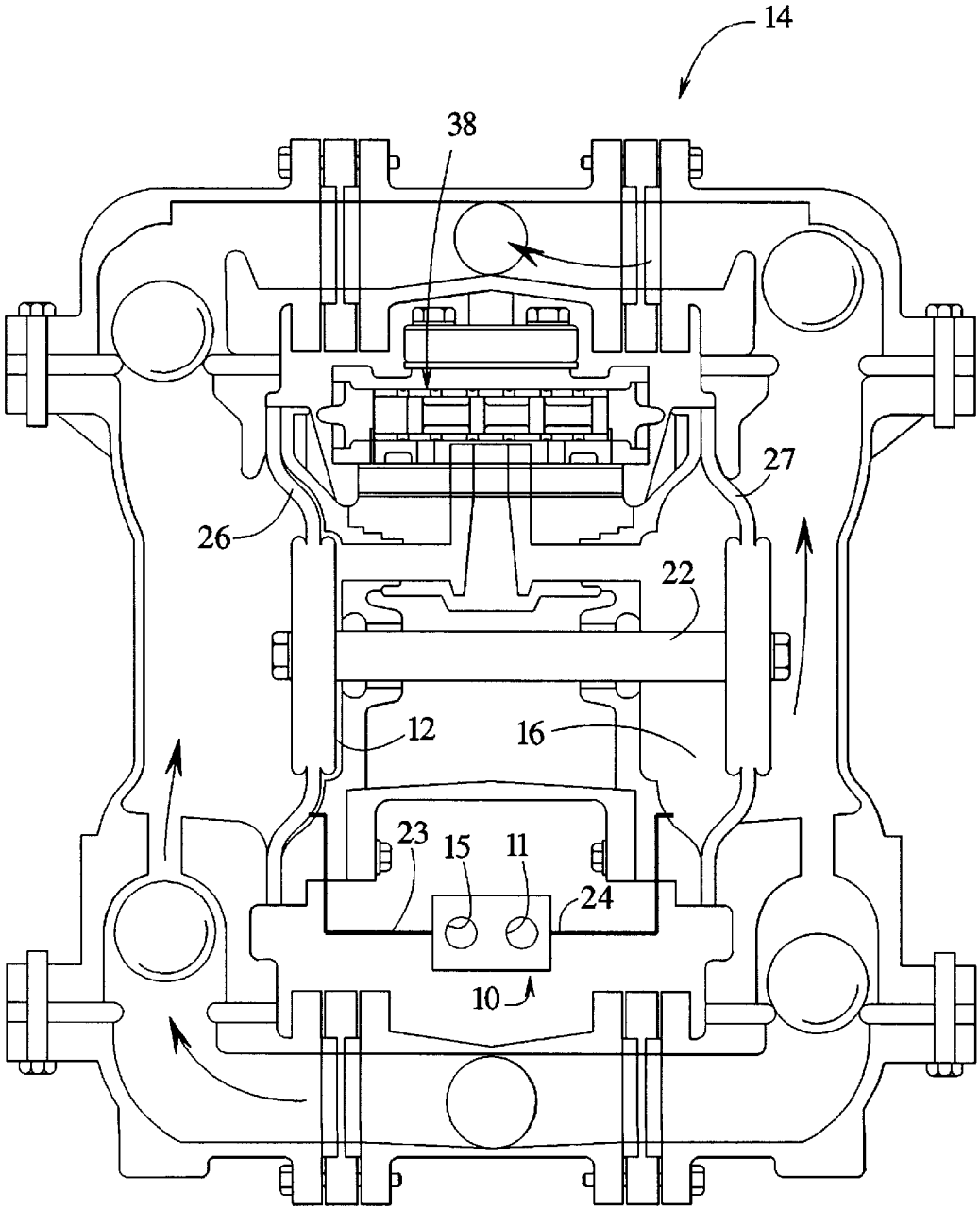
FIG. 2 is a schematic illustration of a diaphragm pump made in accordance with the present invention incorporating the governor or frequency control system of the present invention.

Referring to FIGS. 1 and 2 together, with the pump 14 shifted to the right as shown in FIG. 2, air pressure in the inner chamber 12 is increased as the diaphragm rod 22 moves to the right in FIG. 2. The increase in air pressure in the inner chamber 12 is communicated by way of the line 23 to the chamber 15 which, as shown in FIG. 1, is in communication with the second side 21 of the pump member 18. As a result, the pump member 18 is moved to the left as shown in FIG. 1. In contrast, as the pump 14 shifts and the diaphragm rod 22 moves to the left in FIG. 2, pressure in the inner chamber 16 will increase and the increase in pressure will be communicated through the line 24 to the chamber 11 which, as shown in FIG. 1, is in communication with the first side 17 of the pump member 18. Pressure in the chamber 12 (FIG. 2) will drive the pump member 18 to the right in FIG. 1 while pressure in the chamber 16 (FIG. 2) will retract the pump to the left in FIG. 1. Similarly, pressure in the chamber 16 will cause the other pump (not shown) to pump fluid through the circuit while pressure in the chamber 12 will cause the other pump (not shown) to be retracted. As a result, the pump member 18 will move to the right from the position shown in FIG. 2. In addition to, or as an alternative, a spring 19 is provided to bias the pump member 18 back to the retracted position shown in FIG. 1.

The oscillatory movement of the diaphragm rod 22 and diaphragm 26 and 27 will cause oscillatory increases and decreases in the air pressure in the inner chambers 12, 16 of the pump 14. These increases and decreases in air pressure will be communicated by way of the lines 23, 24 to the chambers 15, 11 and to opposing sides 17, 21 of the pump member 18. As a result, the pump member 18 will move in an oscillatory fashion at the same frequency at which the diaphragm rod 22 moves. In short, the frequency of the pump member 18 will be the same as the frequency of the pump 14.

In the embodiment shown in FIG. 1, the pump member 18 includes a plunger 28 which faces a hydraulic fluid passageway or circuit 31. As the pump member 18 moves back and forth in its oscillatory fashion as discussed above, the plunger 28 pumps the fluid contained in the circuit 31 in the direction of the arrow 32. After the fluid passes the check valve 33 it engages a diaphragm 34 which, in turn, engages a flow regulator valve shown at 35. The flow regulator valve 35 is disposed between an air or power fluid inlet 36 and air or power fluid outlet 37. The air outlet 37 is in communication with the main air valve 38 of the pump 14 as shown in FIG. 2 which directs the air or power fluid into the inner chambers 12,16 in an alternating fashion. Details of the operation of the diaphragm pump 14 shown in FIG. 2 are known to those skilled in the art and need not be described in detail here. However, it should be known that the flowrate of air or power fluid from the outlet 37 to the main air valve 38 will control the frequency at which the pump 14 operates. Accordingly, one way to control the frequency at which the pump 14 operates is to control the flowrate of air supplied to the pump. In accordance with the present invention, the governor 10 controls this flowrate by way of the throttle valve 35 disposed between the inlet 36 and outlet 37.

Specifically, in the event the pump 14 is operating at too high of a frequency, the pump member 18 (and its counterpart which is not shown in FIG. 1) will move in an oscillatory fashion back and forth thereby increasing the flowrate of the fluid through the circuit 31 to a flowrate that is above a predetermined maximum flowrate value. As a result of fluid flowing through the circuit 31 at too high of a flowrate, the diaphragm 34 engages the flow regulator 35 with a sufficient force so as to overcome the bias of the spring 41 thereby depressing the tapered shaft 42 of the flow regulator 35 into the aperture shown at 43. As a result, flowrate from the inlet 36 to the outlet 37 is restricted thereby restricting the flowrate to the main air valve 38.

In contrast, in the event the pump 14 is operated at a rate that is slower than a preferred rate, the pump member 18 (and its counterpart which is not shown in FIG. 1) will also oscillate back and forth at a lower rate thereby resulting in a reduced flowrate of hydraulic fluid through the circuit 31. As a result, force imposed by the diaphragm 34 against the top 44 of the flow regulator 35 will be reduced resulting in the spring 41 biasing the flow regulator 35 and, specifically, the tapered shaft 42 of the flow regulator 35 out of the aperture 43 thereby permitting increased flow from the inlet 36 to the outlet 37. Consequently, flow is increased from the outlet 37 to the main air valve 38 which will result in an increase in the frequency of operation of the pump 14.

As a further control means, a throttle valve 46 is provided in the circuit 31 for controlling the flow of hydraulic fluid through the circuit 31. Thus, the throttle valve 46 provides for a manual control of the flowrate of fluid through the circuit 31 and thereby a manual control of the frequency of the pump 14. In contrast, the system 10 itself provides for an automated control because the system 10 effectively controls the flowrate of air or power fluid entering the main air valve 38 in response to the frequency of operation of the pump 14. As discussed above, the frequency of operation of the pump 14 can vary depending upon changes in viscosity of the fluid being pumped, changes in the number of dispensing stations utilizing the fluid being pumped or a reduction in the flowrate of fluid being pumped by the pump 14 including an emptying of the sump or reservoir of the fluid being pumped which would result in a runaway condition of the pump 14 absent the control system 10 of the present invention or another control system.

Still referring to FIG. 1, downstream of the throttle valve 46 is disposed a fluid reservoir 48. A second check valve 49 is disposed between the fluid reservoir 48 and the pumps, one of which is shown at 18. Thus, in the embodiment illustrated in FIG. 1, the throttle valve 35 is disposed downstream of the pumps. While the throttle valve 46 is disposed downstream of the flow regulator 35 and between the flow regulator 35 and the pumps, the location of the throttle valve 46 is relatively unimportant and other locations in the circuit 31 are possible. Further, in the system 10 shown in FIG. 1, the fluid reservoir 48 is disposed downstream of the flow regulator 35 and upstream of the pumps. However, the reservoir 48 could be disposed downstream of the pumps and upstream of the flow regulator 35 as well. Check valves 33, 49 ensure that the fluid flows in the clockwise direction shown in FIG. 1, or in the direction of the arrow 32.

Still further, referring to FIG. 2, it is apparent that the system 10 may be incorporated into existing pumps 14 in a variety of ways. The only requirement is that communication be established between the inner chambers 12, 16 and opposing sides of an oscillatory member such as a pump member 18 or other suitable oscillatory member which, in turn, is used to pump fluid through a hydraulic circuit, such as the one shown at 31 in FIG. 1. Because the size of the system 10 may be small, there is a variety of ways in which the system 10 could be incorporated into a diaphragm pump 14. Thus, the system 10 can be provided as original equipment on diaphragm pumps, or in the form of a retrofit or modification kit.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

What is claimed is:

1. A governor for an air operated diaphragm pump having two inner chambers, the governor comprising:

a pump member having a first side and a second side, the first side of the pump member being in communication with one inner chamber of the pump, the second side of the pump member being in communication with the other inner chamber of the pump, oscillatory movement of the pump member caused by varying pressures in the inner chambers of the pump causing the pump member to pump hydraulic fluid through a circuit, the hydraulic fluid engaging a flow regulator disposed between a power fluid inlet and a power fluid outlet, the position of a flow regulator controlling the flow rate of power fluid from the inlet to the outlet, the position of the flow regulator being controlled by a flow rate of the hydraulic fluid through the circuit.

2. The governor of claim 1 wherein an increase in the flow rate of the hydraulic fluid through the circuit above a predetermined maximum flow rate results in the flow regulator moving to a position where the flow regulator reduces the flow rate of power fluid from the inlet to the outlet.

3. The governor of claim 1 wherein a decrease in the flow rate of the hydraulic fluid through the circuit below a predetermined minimum flow rate results in the flow regulator moving to a position where the flow regulator increases the flow rate of power fluid from the inlet to the outlet.

4. A governor for an air operated diaphragm pump having two inner chambers, the governor comprising:

a pump member having a first side and a second side, the first side of the pump member being in communication with one of the inner chambers of the pump, the second side of the pump member engaging a spring, oscillatory movement of the pump member caused by varying pressures in the inner chamber of the pump causing the pump member to pump hydraulic fluid through a circuit, the hydraulic fluid engaging a flow regulator disposed between a power fluid inlet and a power fluid outlet, the position of the flow regulator controlling a flow rate of power fluid from the inlet to the outlet, the position of the flow regulator being controlled by a flow rate of the hydraulic fluid through the circuit.

5. The governor of claim 4 wherein an increase in the flow rate of the hydraulic fluid through the circuit above a predetermined maximum flow rate results in the flow regulator moving to a position where the flow regulator reduces the flow rate of power fluid from the inlet to the outlet.

6. The governor of claim 4 wherein a decrease in the flow rate of the hydraulic fluid through the circuit below a predetermined minimum flow rate results in the flow regulator moving to a position where the flow regulator increases the flow rate of power fluid from the inlet to the outlet.

7. A governor for a fluid operated diaphragm pump having left and right inner chambers, the governor comprising:

a left pump member having a first side and a second side, the first side of the left pump member being in communication with the left inner chamber of the pump, the second side of the left pump member being in communication with the right inner chamber of the pump, oscillatory movement of the left pump member caused by varying pressures in the left and right inner chambers of the pump thereby causing the left pump member to pump hydraulic fluid thereby circulating the hydraulic fluid at a flowrate through a hydraulic circuit, a right pump member having a first side and a second side, the first side of the right pump member being in communication with the left inner chamber of the pump, the second side of the right pump member being in communication with the left inner chamber of the pump, oscillatory movement of the right pump member caused by varying pressures in the right and left inner chambers of the pump thereby causing the right pump member to pump hydraulic fluid thereby circulating the hydraulic fluid at the flowrate through the hydraulic circuit, the hydraulic fluid engaging a flow regulator disposed between a power fluid inlet and a power fluid outlet, a position of the flow regulator controlling a flowrate of power fluid from the inlet to the outlet, the position of the flow regulator being controlled by the flowrate of the hydraulic fluid through the circuit.

8. The governor of claim 7 wherein an increase in the flowrate of the hydraulic fluid through the circuit above a predetermined maximum flowrate results in the flow regulator moving to a position where the flow regulator reduces the flowrate of power fluid from the inlet to the outlet.

9. The governor of claim 7 wherein a decrease in the flow rate of the hydraulic fluid through the circuit below a predetermined minimum flowrate results in the flow regulator moving to a position where the flow regulator increases the flowrate of power fluid from the inlet to the outlet.

10. The governor of claim 7 wherein the circuit further comprises a check valve disposed downstream of the pump and upstream of the flow regulator.

11. The governor of claim 7 wherein the circuit further comprises a hydraulic fluid reservoir disposed downstream of the flow regulator and the upstream of the pump members.

12. The governor of claim 11 wherein the circuit further comprises a check valve disposed downstream of the hydraulic fluid reservoir and upstream of the pump members.

13. The governor of claim 7 wherein the circuit further comprises a throttle valve for controlling the flowrate of hydraulic fluid through the circuit.

14. The governor of claim 13 wherein the throttle valve is disposed downstream of the flow regulator and upstream of the pump.

15. The governor of claim 11 wherein the circuit further comprises a throttle valve for controlling the flowrate of hydraulic fluid through the circuit, the throttle valve being disposed downstream of the flow regulator and upstream of the hydraulic fluid reservoir.

16. A governor for an air operated diaphragm pump having left and right inner chambers, the governor comprising:

a left piston having a first side and a second side, the first side of the left piston being in communication with the left inner chamber of the pump, the second side of the left piston being in communication with the right inner chamber of the pump, the left piston being connected to a left plunger, the right plunger being disposed between the left piston and a hydraulic fluid circuit whereby oscillatory movement of the left piston caused by varying pressures in the left and right inner chambers of the pump causes the left plunger to pump hydraulic fluid through a circuit, a right piston having a first side and a second side, the first side of the right piston being in communication with the right inner chamber of the pump, the second side of the right piston being in communication with the left inner chamber of the pump, the right piston being connected to a right plunger, the right plunger being disposed between the right piston and the hydraulic fluid circuit whereby oscillatory movement of the right piston caused by varying pressures in the right and left inner chamber of the pump causes the right plunger to pump the hydraulic fluid through the circuit, the hydraulic fluid engaging a diaphragm disposed between the circuit and a flow regulator, the diaphragm engaging the flow regulator, the flow regulator being disposed between an air inlet and an air fluid outlet, a position of the flow regulator controlling a flowrate of air from the inlet to the outlet, the position of the flow regulator being controlled by a position of the diaphragm, the position of the diaphragm being controlled by the flowrate of the hydraulic fluid through the circuit.

17. The governor of claim 16 wherein an increase in the flowrate of the hydraulic fluid through the circuit above a predetermined maximum flowrate results in the flow regulator moving to a position where the flow regulator reduces the flowrate of air from the inlet to the outlet.

18. The governor of claim 16 wherein a decrease in the flowrate of the hydraulic fluid through the circuit below a predetermined minimum flowrate results in the flow regulator moving to a position where the flow regulator increases the flowrate of air from the inlet to the outlet.

19. A method of controlling the frequency of a diaphragm pump having first and second inner chambers that receive pressurized air from a main air valve, the method comprising:

moving at least one pump member in an oscillatory fashion in response to varying pressures in the first and second inner chambers;

pumping hydraulic fluid at a flow rate through a circuit under the movement of the pump member, the hydraulic fluid engaging a flow regulator, the flow regulator being disposed between a power fluid inlet and a power fluid outlet and the position of the flow regulator controlling a flow rate of power fluid between the inlet and the outlet, the outlet being in communication with the main valve of the pump;

moving the flow regulator in response to the flowrate of the hydraulic fluid through the circuit.

20. A diaphragm pump comprising:

left and right inner chambers in communication with a main air valve, the main air valve in communication with an air supply outlet, the air supply outlet in communication with an air supply inlet, the pump further comprising a governor comprising a left piston having a first side and a second side, the first side of the left piston being in communication with the left inner chamber of the pump, the second side of the left piston being in communication with the right inner chamber of the pump, the left piston being connected to a left plunger, the left plunger being disposed between the left piston and a hydraulic fluid circuit whereby oscillatory movement of the left piston caused by varying pressures in the left and right inner chambers causes the left plunger to pump the hydraulic fluid through the circuit, the governor further comprising a right piston having a first side and a second side, the first side of the right piston being in communication with the right inner chamber of the pump, the second side of the right piston being in communication with the right inner chamber of the pump, the right piston being connected to a right plunger, the right plunger being disposed between the right piston and the hydraulic fluid circuit whereby oscillatory movement of the right piston caused by varying pressures in the right and left inner chambers causes the right plunger to pump hydraulic fluid through the circuit, the hydraulic fluid engaging a diaphragm disposed between the circuit and a flow regulator, the diaphragm engaging the flow regulator, the flow regulator being disposed between the air supply inlet and the air supply outlet, the position of the flow regulator between the air supply inlet and air supply outlet controlling the flowrate of air from the air supply inlet to the air supply outlet, the position of the flow regulator being controlled by the position of the diaphragm, the position of the diaphragm being controlled by the flowrate of the hydraulic fluid through the circuit, an increase in the flowrate of the hydraulic fluid through the circuit above a predetermined maximum flowrate results in the flow regulator moving to a position where the flow regulator reduces the flowrate of air from the air supply inlet to the air supply outlet, and a decrease in the flowrate of the hydraulic fluid through the circuit below a predetermined minimum flowrate results in the flow regulator moving to a position where the flow regulator increases the flowrate of air from the air supply inlet to the air supply outlet.

* * * * *